US009498817B1

(12) United States Patent
Lin

(10) Patent No.: US 9,498,817 B1
(45) Date of Patent: Nov. 22, 2016

(54) BARREL ASSEMBLY FOR A RIVET GUN

(71) Applicant: Yu-Tang Lin, New Taipei (TW)

(72) Inventor: Yu-Tang Lin, New Taipei (TW)

( * ) Notice: Subject to any disclaimer, the term of this patent is extended or adjusted under 35 U.S.C. 154(b) by 0 days.

(21) Appl. No.: 14/938,201

(22) Filed: Nov. 11, 2015

(51) Int. Cl.
*B21J 15/18* (2006.01)
*B21J 15/10* (2006.01)
*B21J 15/32* (2006.01)

(52) U.S. Cl.
CPC ..... *B21J 15/18* (2013.01); *B21J 15/105* (2013.01); *B21J 15/326* (2013.01)

(58) Field of Classification Search
CPC ..... B21J 15/18; B21J 15/105; B21J 15/326
USPC ..... 29/243.523
See application file for complete search history.

(56) References Cited

U.S. PATENT DOCUMENTS 2,876,742 A * 3/1959 Sherrill ..... B21C 31/00 91/32
3,232,180 A * 2/1966 Deschenes ..... B21J 15/18 91/392
4,045,994 A * 9/1977 Di Maio ..... B21J 15/105 29/243.523
4,693,322 A * 9/1987 Gartside ..... B21J 7/24 164/229
5,855,054 A * 1/1999 Rivera ..... B21J 15/02 29/243.54
8,074,733 B2 * 12/2011 Liu ..... B21J 15/043 173/168
2004/0139590 A1 * 7/2004 Eldessouky ..... B21J 15/105 29/243.523
2012/0174362 A1 * 7/2012 Lv ..... B21J 15/043 29/243.525
2013/0149049 A1 * 6/2013 Klein ..... B21J 15/326 406/152

* cited by examiner

*Primary Examiner* — Joseph J Hail
*Assistant Examiner* — Henry Hong
(74) *Attorney, Agent, or Firm* — Pai Patent & Trademark Law Firm; Chao-Chang David Pai

(57) ABSTRACT

A barrel assembly for a rivet gun has a barrel, a piston, a rear plug, a fluid tube, a control valve tube and a spring. The barrel has a cavity. The piston is mounted slidably in the cavity and has a rivet ejection passageway. The rear plug is mounted on a rear end of the barrel and has an assembling hole and a sliding passageway. The fluid tube is mounted detachably in the rear end of a head of the piston. The control valve tube is detachably mounted on the rear end of the fluid tube and is mounted slidably in the sliding passageway. With the fluid tube and the control valve tube, the barrel assembly efficiently prevents the high pressure air from continuously leaking out after the pin pulling action is finished.

5 Claims, 5 Drawing Sheets

BARREL ASSEMBLY FOR A RIVET GUN

BACKGROUND OF THE INVENTION

1. Field of the Invention

The present invention relates to a barrel assembly, and more particularly to a barrel assembly for a rivet gun that prevents pneumatic cylinder from outputting high pressure air after an operation of pulling a rivet is completed, which reduces high pressure air consumption.

2. Description of Related Art

A conventional rivet gun is used to rivet two boards such that the boards are securely mounted together by rivets. A rivet has a cap and a core pin. The cap is T-shaped and has an enlarged end and a mounting end. The core pin is mounted longitudinally through and protrudes out of the cap and has two ends and a ball formed on one end and adjacent to the mounting end of the cap.

A conventional rivet gun comprises a barrel, a handle, a trigger, a pin collector and a pneumatic cylinder.

The barrel has a front end, a rear end and a vise assembly that may vise and pull a core pin of a rivet on the front end into the barrel. The handle is mounted perpendicularly on the barrel and has air passageways. The collector is a jar mounted on the rear end of the barrel to collect the ejected core pins. The pneumatic cylinder is mounted movably under the handle and capable of activating the vise assembly through pneumatic and hydraulic means. Furthermore, the pneumatic cylinder may be connected to a high-pressure air source such as an air bottle to implement the ejection of the core pin.

When the rivet gun is used to rivet two pieces such as boards or plates together, a rivet is mounted through the pieces. The enlarged end of the cap of the rivet abuts an inside piece, and the front end of the barrel of the rivet gun abuts the enlarged end. The trigger is pulled to activate the vise assembly to pull a core pin on the cap into the barrel. The ball on the core pin longitudinally compresses and radially expands the mounting end of the cap into T-shape so that the expanded mounting end hooks on an outside piece to complete the riveting process. Then, the air output by the high-pressure air source flows through the barrel from the front end to the rear end and sucks the broken core pin vised by the vise assembly backward into the collector.

Furthermore, a bypass hole is defined through the barrel and communicates with the air passageways. Therefore, when the trigger is pulled, the high pressure air in the pneumatic cylinder passes through air passageways and the bypass hole into the barrel and drives the vise assembly to move backward to pull the rivet.

However, after the vise assembly completes the action of pulling the rivet and stays at a rear position, the pneumatic cylinder continues outputting high pressure air through the bypass hole to external atmosphere, which meaninglessly consumes the high pressure air.

To overcome the shortcomings, the present invention provides a barrel assembly to mitigate or obviate the aforementioned problems.

SUMMARY OF THE INVENTION

The main objective of the invention is to provide a barrel assembly for a rivet gun that prevents pneumatic cylinder from outputting high pressure air after an operation of pulling a rivet is completed, which reduces high pressure air consumption.

A barrel assembly for a rivet gun in accordance with the present invention has a barrel, a piston, a rear plug, a fluid tube, a control valve tube and a spring. The barrel has a cavity. The piston is mounted slidably in the cavity and has a rivet ejection passageway. The rear plug is mounted on a rear end of the barrel and has an assembling hole and a sliding passageway. The fluid tube is mounted detachably in the rear end of a head of the piston. The control valve tube is detachably mounted on the rear end of the fluid tube and is mounted slidably in the sliding passageway. With the fluid tube and the control valve tube, the barrel assembly efficiently prevents the high pressure air from continuously leaking out after the pin pulling action is finished.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
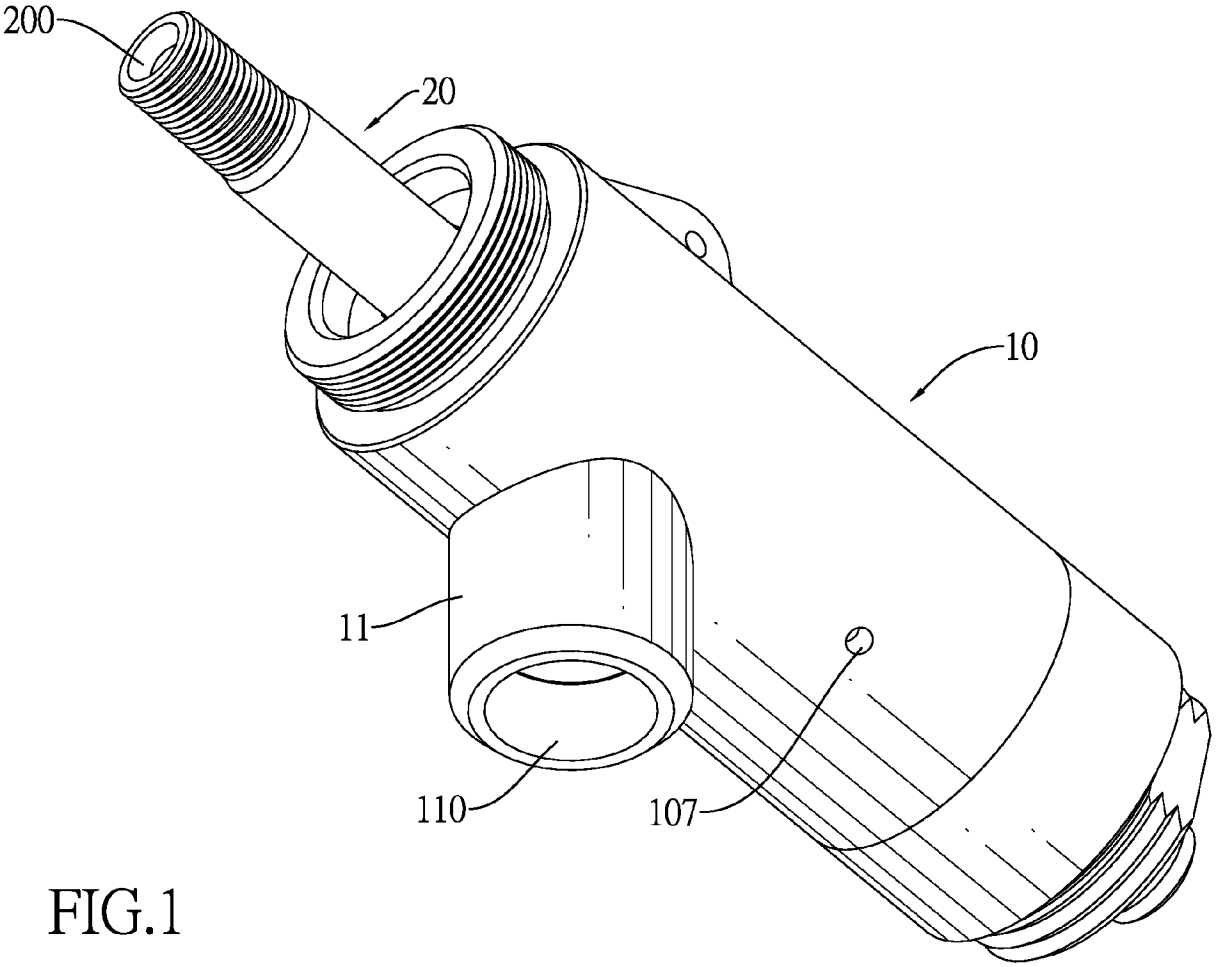
FIG. 1 is a perspective view of a barrel assembly for a rivet gun in accordance with the present invention.
Figure 2:
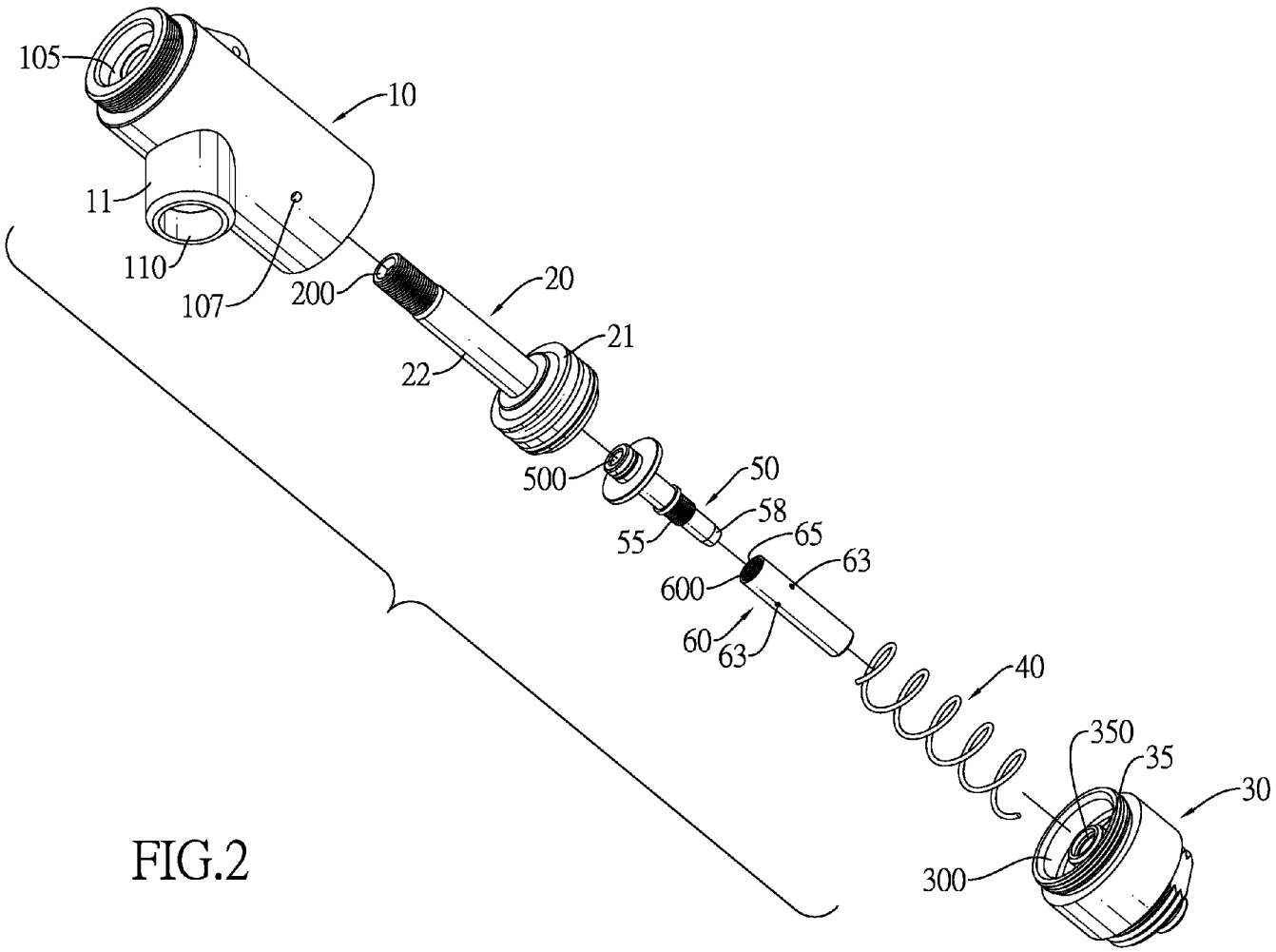
FIG. 2 is an exploded perspective view of the barrel assembly in FIG. 1.

With reference to FIGS. 1 and 2, a barrel assembly for a rivet gun in accordance with the present invention comprises a barrel 10, a piston 20, a rear plug 30, a fluid tube 50, a control valve tube 60 and a spring 40.

Figure 3:
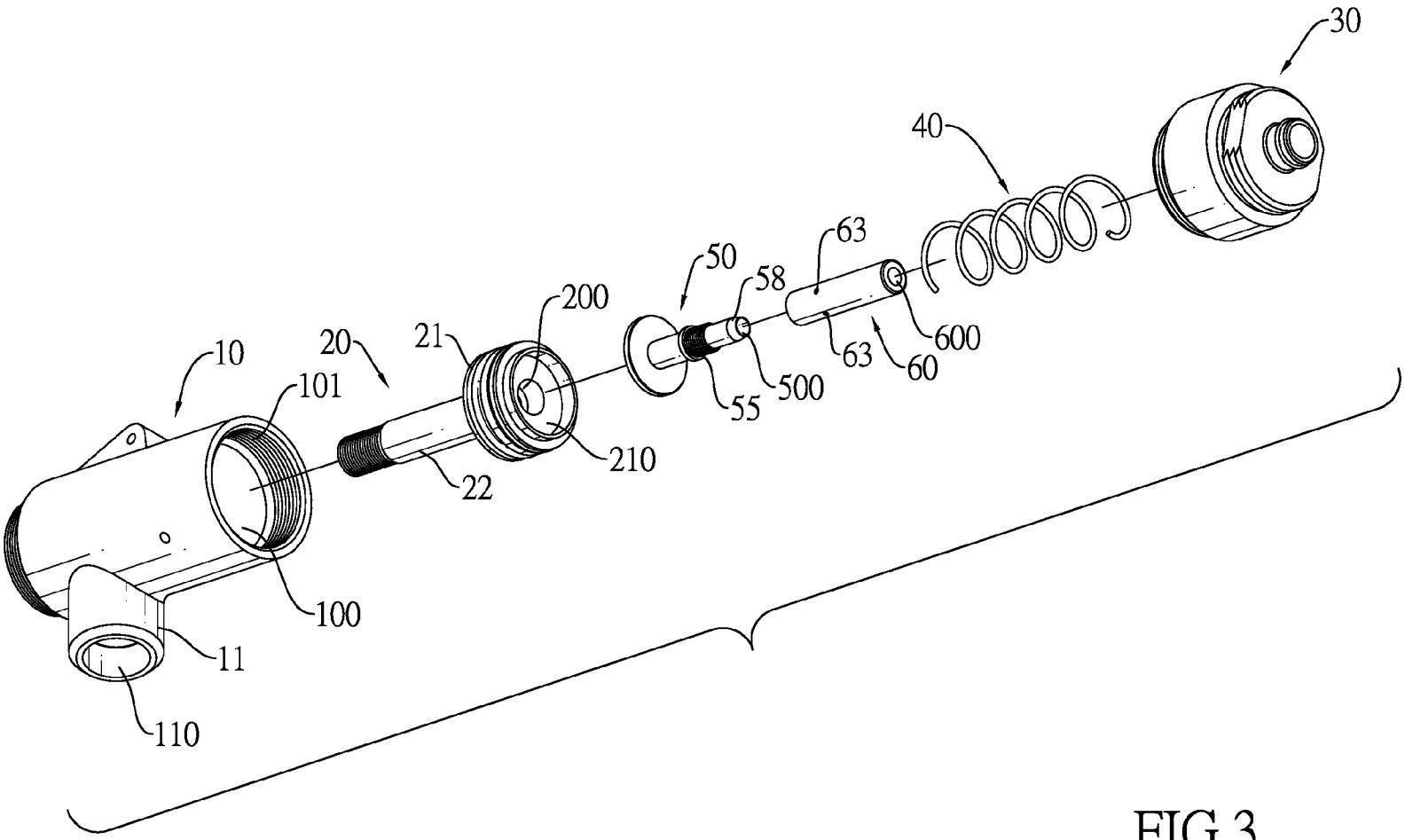
FIG. 3 is another exploded perspective view of the barrel assembly in FIG. 1.
Figure 4:
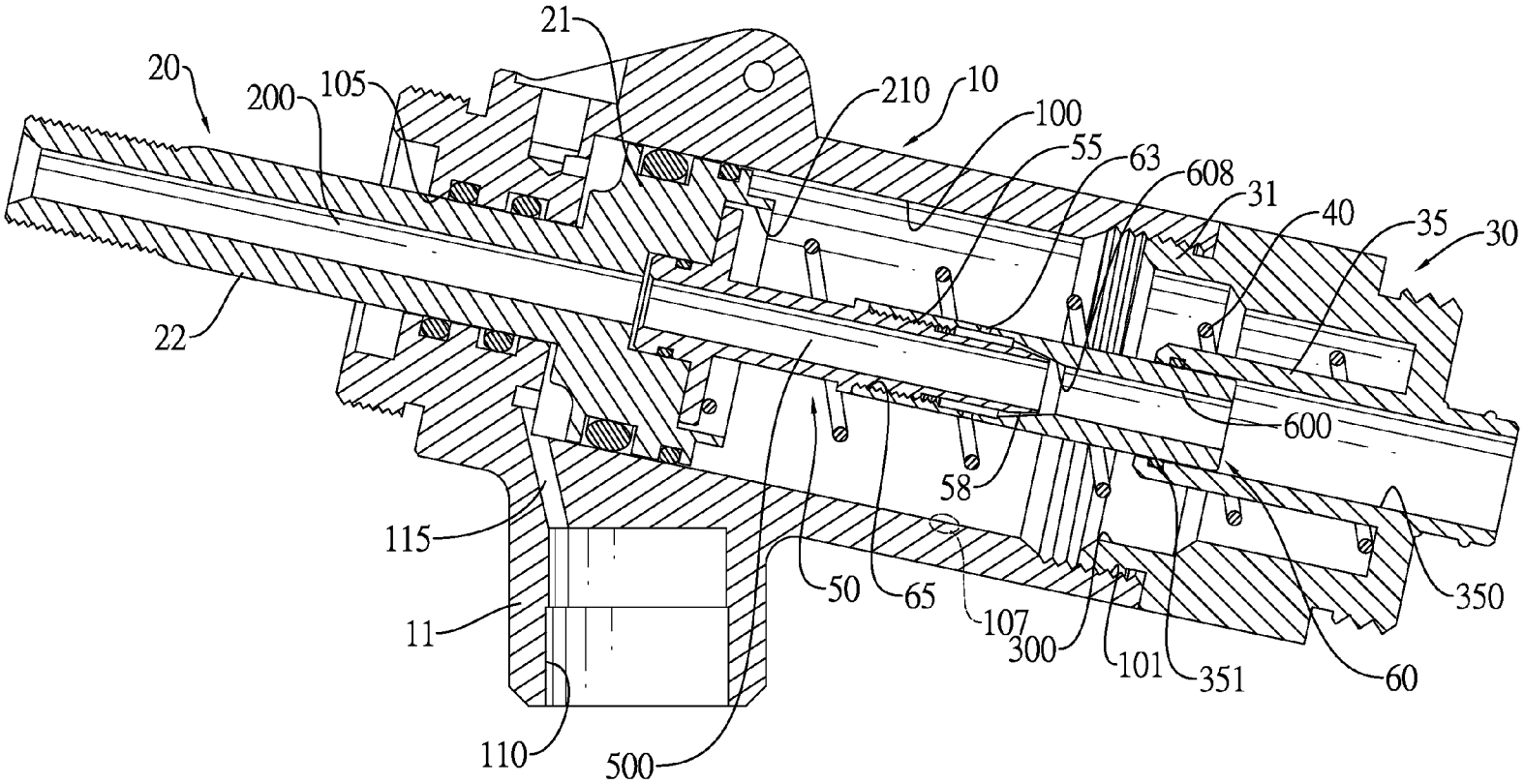
FIG. 4 is a cross sectional side view of the barrel assembly in FIG. 1.

With further reference to FIGS. 3 and 4, the barrel 10 has a cavity 100, an inner thread 101, a mounting hole 105, a high pressure inlet hole 107 and a handgrip sleeve 11.

The cavity 100 is defined axially in a rear end of the barrel 10.

The inner thread 101 is formed on an inner surface of the cavity 100 near the rear end of the barrel 10.

The mounting hole 105 is defined axially in a front end of the barrel 10 and communicates with the cavity 100.

The high pressure inlet hole 107 is defined radially in the barrel 10 and communicates with the cavity 100.

The handgrip sleeve 11 is formed radially on the barrel 10 and has a sleeve hole 110 and a hydraulic hole 115. The sleeve hole 110 is defined axially in a bottom of the handgrip sleeve 11 and may accommodate a handgrip. The hydraulic hole 115 is defined in the handgrip sleeve 11 and is disposed between and communicates with the cavity 100 and the sleeve hole 110.

The piston 20 is mounted slidably in the cavity 100 of the barrel 10 and has a head 21, a rod 22 and a rivet ejection passageway 200.

The head 21 is mounted slidably in the cavity 100 of the barrel 10, airtightly contacts the inner surface of the cavity 100, and has a mounting slot 210. The mounting slot 210 is defined in a rear end of the head 21.

The rod 22 is formed on and protrudes forward from the head 21 and extends through the mounting hole 105 of the barrel 10.

The rivet ejection passageway 200 is defined through the head 21 and the rod 22.

The rear plug 30 is mounted detachably on the rear end of the barrel 10 and has an assembling hole 300, an outer thread 31 and an airflow controlling tube 35.

The assembling hole 300 is defined axially in a front end of the rear plug 30.

The outer thread 31 is formed on an outer surface of the rear plug 30 and is engaged detachably with the inner thread 101 of the barrel 10.

The airflow controlling tube 35 is formed in the assembling hole 300 and has a sliding passageway 350 and a sealing ring 351. The sliding passageway 350 is defined axially through the airflow controlling tube 35. The sealing ring 351 is mounted on an inner surface of the sliding passageway 350 near a front end of the sliding passageway 350.

The fluid tube 50 is mounted detachably in the rear end of the head 21 of the piston 20 and has a front end, a rear end, a rivet ejection hole 500, an outer threaded portion 55 and an outer conical surface 58.

The front end of the fluid tube 50 is mounted detachably in the mounting slot 210 of the head 21.

The rivet ejection hole 500 is defined axially through the fluid tube 50 and communicates with the rivet ejection passageway 200.

The outer threaded portion 55 is formed on an outer surface of the fluid tube 50.

The outer conical surface 58 is formed on the rear end of the fluid tube 50.

The control valve tube 60 is detachably mounted on the rear end of the fluid tube 50, is mounted slidably in the sliding passageway 350 of the airflow controlling tube 35, airtightly contacts the sealing ring 351 in the sliding passageway 350, and has a rivet ejection channel 600, at least one valve hole 63, an inner threaded portion 65 and an inner conical surface 608.

The rivet ejection channel 600 is defined axially through the control valve tube 60 and communicates with the rivet ejection hole 500 of the fluid tube 50.

The at least one valve hole 63 is defined radially in the control valve tube 60, communicates with the rivet ejection channel 600 and selectively moves in or out of the sliding passageway 350. When the control valve tube 60 slides to a forward position relative to the sliding passageway 350, the at least one valve hole 63 moves out of the sliding passageway 350 and communicates with the cavity 100 such that the cavity 100 communicates with the rivet ejection channel 600 and the rivet ejection hole 500. When the control valve tube 60 slides to a backward position relative to the sliding passageway 350, the at least one valve hole 63 moves in the sliding passageway 350 and is isolated from the cavity 100 such that the cavity 100 is isolated from the rivet ejection channel 600 and the rivet ejection hole 500.

The inner threaded portion 65 is formed on an inner surface of the rivet ejection channel 600 at a front end of the rivet ejection channel 600 and is engaged with the outer threaded portion 55.

The inner conical surface 608 is formed on the inner surface of the rivet ejection channel 600, surrounds the outer conical surface 58 with an interval defined between the inner conical surface 608 and the outer conical surface 58.

Sliding the control valve tube 60 controls high pressure air of a high-pressure air source connected to the rivet gun to flow from the cavity 100 to the rivet ejection channel 600.

The spring 40 is mounted around the fluid tube 50 and the airflow controlling tube 35 and has two ends respectively abutting the fluid tube 50 and the rear plug 30.

With reference to FIG. 4, when the rivet gun is triggered to pull a pin of a rivet, the control valve tube 60, fluid tube 50 and piston 20 move forward such that the at least one valve hole 63 moves out of the sliding passageway 350. At the meantime the high pressure air enters the cavity 100 through the high pressure inlet hole 107, sequentially passes through the at least one valve hole 63, the rivet ejection channel 600, and the sliding passageway 350, and then is finally discharged backward out of the barrel 10. The high pressure air drives a broken pin of a rivet inside the barrel 10 to move back through the rivet ejection passageway 200 and the sliding passageway 350 and out of the barrel 10. The discharged broken pin finally falls into a pin collector that is connected to the rear end of the barrel 10.

Figure 5:
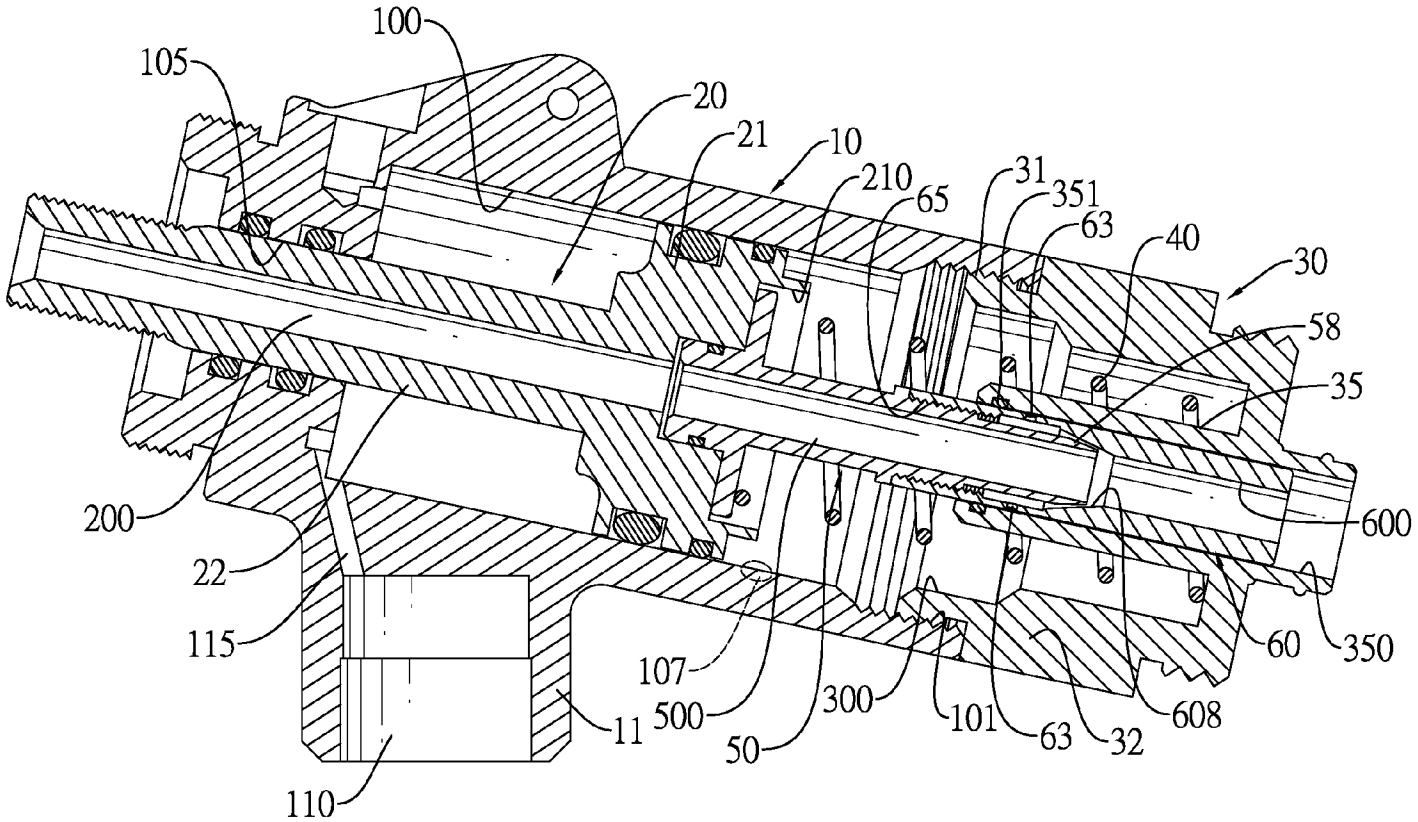
FIG. 5 is an operational cross sectional side view of the barrel assembly in FIG. 4.

With reference to FIG. 5, when the pin pulling action is completed, the control valve tube 60, fluid tube 50 and the piston 20 move backward to move the at least one valve hole 63 back into the sliding passageway 350 such that the cavity 100 is re-isolated from the rivet ejection channel 600 and the sliding passageway 350 to prevent the high pressure air from continuously leaking out.

The barrel assembly in accordance with the present invention efficiently prevents the high pressure air from continuously leaking out after the pin pulling action is finished. Furthermore, the fluid tube 50 and the control valve tube 60 are detachable and replaceable to facilitate maintenance of the rivet gun and applicability for different rivet guns.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A barrel assembly for a rivet gun comprising:

a barrel having a cavity defined axially in a rear end of the barrel;

a mounting hole defined axially in a front end of the barrel and communicating with the cavity; and a high pressure inlet hole defined radially in the barrel and communicating with the cavity;

a piston mounted slidably in the cavity of the barrel and having a head mounted slidably in the cavity of the barrel and airtightly contacting an inner surface of the cavity;

a rod formed on and protruding forward from the head and extending through the mounting hole of the barrel; and a rivet ejection passageway defined through the head and the rod;

a rear plug mounted detachably on the rear end of the barrel and having an assembling hole defined axially in a front end of the rear plug; and an airflow controlling tube formed in the assembling hole and having a sliding passageway defined axially through the airflow controlling tube;

a fluid tube mounted detachably in a rear end of the head of the piston and having a rivet ejection hole defined axially through the fluid tube and communicating with the rivet ejection passageway;

a control valve tube detachably mounted on a rear end of the fluid tube, mounted slidably in the sliding passageway of the airflow controlling tube, and having a rivet ejection channel defined axially through the control valve tube and communicating with the rivet ejection hole of the fluid tube; and at least one valve hole defined radially in the control valve tube, communicating with the rivet ejection channel, and selectively moving in or out of the sliding passageway, wherein when the control valve tube slides to a forward position relative to the sliding passageway, the at least one valve hole moves out of the sliding passageway and communicates with the cavity such that the cavity communicates with the rivet ejection channel and the rivet ejection hole, and when the control valve tube slides to a backward position relative to the sliding passageway, the at least one valve hole moves in the sliding passageway and is isolated from the cavity such that the cavity is isolated from the rivet ejection channel and the rivet ejection hole; and a spring mounted around the fluid tube and having two ends respectively abutting the fluid tube and the rear plug.

2. The barrel assembly as claimed in claim 1, wherein the fluid tube has an outer threaded portion formed on an outer surface of the fluid tube; and an outer conical surface formed on a rear end of the fluid tube; and the control valve tube has an inner threaded portion formed on an inner surface of the rivet ejection channel at a front end of the rivet ejection channel and engaged with the outer threaded portion; and an inner conical surface formed on the inner surface of the rivet ejection channel, surrounding the outer conical surface with an interval defined between the inner conical surface and the outer conical surface.

3. The barrel assembly as claimed in claim 2, wherein the rear plug has a sealing ring mounted on an inner surface of the sliding passageway near a front end of the sliding passageway and airtightly contacting the control valve tube.

4. The barrel assembly as claimed in claim 3, wherein the barrel has an inner thread formed on the inner surface of the cavity near the rear end of the barrel; and the rear plug has an outer thread formed on an outer surface of the rear plug and engaged detachably with the inner thread of the barrel.

5. The barrel assembly as claimed in claim 4, wherein the barrel has a handgrip sleeve formed radially on the barrel and having a sleeve hole defined axially in a bottom of the handgrip sleeve; and a hydraulic hole defined in the handgrip sleeve and disposed between and communicating with the cavity and the sleeve hole.

* * * * *